US005215878A

United States Patent [19]

Tsol

[11] Patent Number: 5,215,878

[45] Date of Patent: Jun. 1, 1993

[54] BENZOYLACETANILIDE PHOTOGRAPHIC YELLOW DYE IMAGE-FORMING COUPLERS AND PHOTOGRAPHIC ELEMENTS CONTAINING THEM

[75] Inventor: Siu C. Tsol, Watford Herts, United Kingdom

[73] Assignee: Eastman Kodak Company, Rochester, N.Y.

[21] Appl. No.: 716,046

[22] Filed: Jun. 17, 1991

Related U.S. Application Data

[63] Continuation of Ser. No. 464,482, Jan. 12, 1990, abandoned.

[51] Int. Cl.[5] ..... G03C 1/08

[52] U.S. Cl. ..... 430/557; 430/556

[58] Field of Search ..... 430/557, 556

[56] References Cited

U.S. PATENT DOCUMENTS

| | | | |
|---|---|---|---|
| 3,664,841 | 5/1972 | Iwama et al. | 430/557 |
| 3,730,722 | 5/1973 | Inoue et al. | 430/557 |
| 4,230,851 | 10/1980 | Renner et al. | 544/183 |
| 4,327,175 | 4/1982 | Toda et al. | 430/557 |
| 4,511,649 | 4/1985 | Ogawa et al. | 430/557 |
| 4,529,691 | 7/1985 | Renner et al. | 430/556 |
| 4,587,207 | 5/1986 | Tsuda et al. | 430/557 |
| 4,824,773 | 4/1989 | Sato et al. | 430/557 |
| 4,977,073 | 12/1990 | Ishige | 430/557 |
| 4,978,605 | 12/1990 | Tsoi | 430/557 |

FOREIGN PATENT DOCUMENTS

| | | | |
|---|---|---|---|
| 46-19031 | 5/1971 | Japan | 430/557 |
| 0204259 | 9/1987 | Japan | 430/557 |

OTHER PUBLICATIONS

Research Disclosure, No. 18053, pp. 198-201, Apr. 1979, Anonymous.

*Primary Examiner*—Charles L. Bowers, Jr.
*Assistant Examiner*—Thomas R. Neville
*Attorney, Agent, or Firm*—Arthur E. Kluegel

[57] ABSTRACT

A photographic element is described which comprises a non-diffusible yellow dye-forming coupler having improved solubility in conventional coupler solvents. Yellow dye-forming couplers are also described.

5 Claims, No Drawings

BENZOYLACETANILIDE PHOTOGRAPHIC YELLOW DYE IMAGE-FORMING COUPLERS AND PHOTOGRAPHIC ELEMENTS CONTAINING THEM

This is a continuation of application Ser. No. 464,482, filed Jan. 12, 1990, now abandoned.

This invention relates to benzoylacetanilide photographic yellow dye image-forming couplers and to photographic elements containing them.

Couplers of the benzoylacetanilide class are known which contain a heterocyclic coupling-off group, for example as described in U.S. Pat. Nos. 4,230,851, 4,327,175 and 4,529,691. Such couplers have good solubility in conventional coupler solvents.

Recently, benzoylacetanilide couplers having aryloxy coupling-off group having been of interest as providing image dyes of excellent hue and high extinction coefficient. These couplers, however, tend to be less soluble in coupler solvents than is desirable.

A coupler of this class has been generally described in U.S. Pat. No. 4,511,649 (coupler (10)), whose ballast group is attached to the anilide ring of the coupler via an ester group, the moiety having the formula —CO—O—$C_{12}H_{25}$. Couplers having such a ballast group have less than the desired solubility in coupler solvents.

The present invention provides couplers of the benzoylacetanilide type having an aryloxy coupling-off group having improved solubility in coupler solvents and also provides photographic elements containing such couplers.

According to the present invention there is provided photographic recording material comprising a support, a silver halide emulsion layer and associated therewith a non-diffusible dye-forming coupler of the general formula:

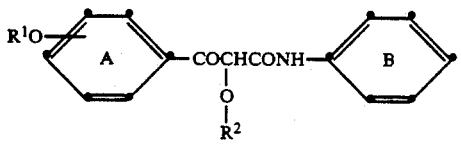

wherein $R^1$ is a cyclic or non-cyclic aliphatic hydrocarbon containing up to 20 carbon atoms which may be substituted or unsubstituted, branched or unbranched, or a ballasting group;

$R^2$ is an aryl group of from 6 to 20 carbon atoms which may be substituted or unsubstituted, and wherein at least one of the rings A and B contains a ballasting substituent comprising an alkyl group whose chain is interrupted by an ester group. The ballasting substituent may be comprised by $R^1$.

The present invention also provides a nondiffusible coupler of the general formula:

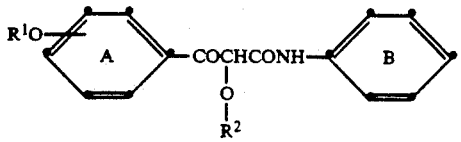

wherein $R^1$ is a cyclic or non-cyclic aliphatic hydrocarbon containing up to 20 carbon atoms which may be substituted or unsubstituted, branched or unbranched, or a ballasting group;

$R^2$ is an aryl group of from 6 to 20 carbon atoms which may be substituted or unsubstituted, and wherein at least one of the rings A and B contains a ballasting substituent comprising an alkyl group whose chain is interrupted by an ester group. The ballasting substituent may be comprised by $R^1$.

The present couplers are non-diffusible in photographic elements hence will contain one or more ballasting substituents of sufficient size and configuration to ensure this. As is well understood the necessary bulk may be divided among more than one substituent if desired. The ballast groups may form part of $R^1$ and/or may be directly or indirectly linked to one or both of rings (A) and (B).

The aryl group $R^2$ may be substituted with one or more substituents selected from alkyl, amide, ester, carbamoyl, sulphonamide, sulphamoyl, sulphone, ether, thioether, nitrile, nitro groups and halogen atoms in any position.

The ballast groups may have the formula:

$$-(CH_2)_p-L^1-(CH_2)_q-CH_3$$

in which $L^1$ is —O—CO or —CO—O—, and p and q are each 1-25.

Examples of ballast groups which may be employed in the present couplers are:

$$-(CH_2)_2-O-CO-C_{12}H_{25}-n,$$
$$-(CH_2)_2-O-CO-C_7H_{15}-n,$$

$$-(CH_2)_{10}-CO-O-C_2H_5-n,$$
$$-(CH_2)_2-O-CO-CH(Et)Bu.$$

A preferred group of couplers according to the present invention have the general formula:

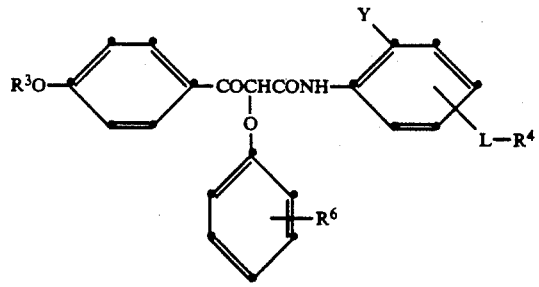

(II)

wherein

R3 and $R^4$ are each a substituted or unsubstituted alkyl group,

Y is chloro or trifluoromethyl,

L is —COO—, —OCO—, —$NR^7$CO—,—CONR$^7$, —$NR^7SO_2$, —SONR$^7$, —O—, —$OSO_2$ or a single bond, $R^6$ is one or more substituent selected from alkyl, amide, carbamoyl, sulphonamide, sulphamoyl, sulphone, ester, ether, thioether, nitrile, nitro groups and halogen atoms, $R^7$ is H or alkyl, and in which the ballast group is constituted by $R^3$ and/or $R^4$ and when R4 is not a ballast group, —$LR^4$ may also be trifluoromethyl, chloro, —NHPO(OR)$_2$ or —PO(OR)$_2$ wherein R is alkyl or aryl. Examples of the groups which $R^1$ and $R^3$ may represent are alicyclic groups of 5 to 6 carbon atoms, and non-cyclic groups of 1–20 carbon atoms which may be substituted or unsubstituted, saturated or unsaturated, e.g. methyl, ethyl, n-butyl, n-dodecyl, n-hexadecyl, n-undecyl and benzyl.

Examples of coupling-off groups ($R^2O$— in formula (I) are shown below together with the names by which they will be identified herein;

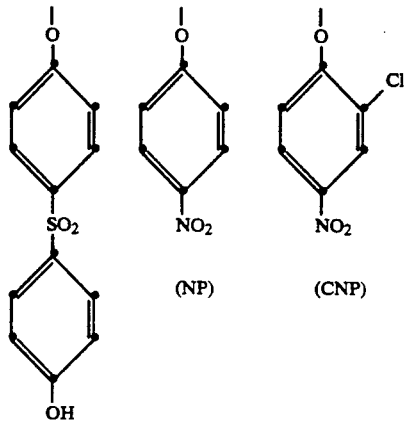

(SDP)

The dye-forming couplers of this invention can be used in the ways and for the purposes that dye-forming couplers have been previously used in the photographic art.

Typically, the couplers are associated with a silver halide emulsion layer coated on a support to form a photographic element. As used herein, the term "associated with" signifies that the coupler is incorporated in the silver halide emulsion layer or in a layer adjacent thereto where, during processing, it is capable of reacting with silver halide development products.

Typically the coupler is dissolved in a coupler solvent and this solution is dispersed in an aqueous gelatin solution. Examples of coupler solvents that may be used are dibutyl phthalate, tricresyl phosphate, diethyl lauramide and 2,4-di-tertiaryamylphenol. In addition an auxilliary coupler solvent may also be used, for example ethyl acetate, cyclohexanone, and 2-(2-butoxyethoxy)ethyl acetate, which are removed from the dispersion before incorporation into the photographic element.

The photographic elements can be single color elements or multicolour elements. In a multicolor element, the yellow dye-forming couplers of this invention would usually be associated with a blue-sensitive emulsion, although they could be associated with an emulsion sensitized to a different region of the spectrum, or with a panchromatically sensitized, orthochromatically sensitized or unsensitized emulsion. Multicolor elements contain dye image-forming units sensitive to each of the three primary regions of the spectrum. Each unit can be comprised of a single emulsion layer or of multiple emulsion layers sensitive to a given region of the spectrum. The layers of the elements, including the layers of the image-forming units, can be arranged in various orders as known in the art.

A typical multicolor photographic element comprises a support bearing a yellow dye image-forming unit comprised of at least one blue-sensitive silver halide emulsion layer having associated therewith at least one yellow dye-forming coupler being a coupler of this invention, and magenta and cyan dye image-forming units comprising at least one green- or red-sensitive silver halide emulsion layer having associated therewith at least one magenta or cyan dye-forming coupler respectively. The element can contain additional layers, such as filter layers.

In the following discussion of suitable materials for use in the emulsions and elements of this invention, reference will be made to Research Disclosure, December 1978, Item 17643, published by Industrial Opportunities Ltd., The Old Harbourmaster's, 8 North Street, Emsworth, Hants P010 7DD, U.K. This publication will be identified hereafter as "Research Disclosure".

The silver halide emulsion employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers of this invention, the elements of the invention can include additional couplers as described in Research Disclosure Section VII, paragraphs D, E, F and G and the publications cited therein. The couplers of this invention and any additional couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (see Research Disclosure Section VI), antistain agents and image dye stabilizer (see Research Disclosure Section VII, paragraphs I and J), light absorbing and scattering materials (see Research Disclosure Section VIII), hardeners (see Research Disclosure Section XII, plasticizers and lubricants (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the elements with a color developing agent to reduce developable silver halide and oxidize the color developing agent. Oxidized color developing agent in turn reacts with the coupler to yield a dye.

Preferred color developing agents are phenylene diamines. Especially preferred are 4-amino-3-methyl-N,N-diethylaniline hydrochloride, 4-amino-3-methyl-N-ethyl-N-β-(methylanesulphonamido)ethylaniline sulphate hydrate, 4-amino-3-methyl-N-ethyl-N-β-(methanesulphonamido)ethyl-N,N-diethylaniline hydrochloride and 4-amino-N-ethyl-N-(2-methoxy-ethyl)-m-toluidine di-p-toluene sulphonate.

With negative-working silver halide emulsions this processing step leads to a negative image. To obtain a positive (or reversal) image, this step can be preceded by development with a non-chromagenic developing agent to develop exposed silver halide, but not form dye, and then uniform fogging of the elements to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

Specific examples of couplers according to the present invention are listed in Table I below.

TABLE I

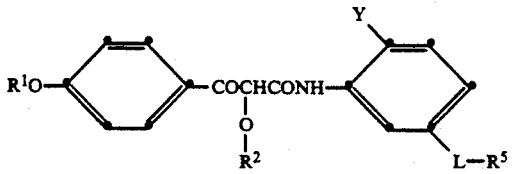

| Coupler | $R^1$ | $L-R^5$ | $OR^2$ |
|---|---|---|---|
| 1 | $-CH_3$ | $-COO(CH_2)_2O-COC_{12}H_{25}$-n | SDP |
| 2 | $-(CH_2)_{10}COOC_2H_5$ | $-Cl$ | SDP |
| 3 | $-(CH_2)_{10}COOC_2H_5$ | $-CF_3$ | SDP |
| 4 | n-BuO | $-CO_2CH_2CH_2OCO(CH_2)_6CH_3$ | SDP |
| 5 | n-BuO | $-CO_2CH_2CH_2OCOCH(Et)Bu$-n | SDP |

The present couplers may be prepared by methods in themselves known. A specific preparation is given below.

The following Examples are included for a better understanding of the invention.

EXAMPLE 1

Solubility Test for Couplers

Each test coupler (0.24 g) together with di-n-butylphthalate (0.12 g) and ethyl acetate (0.72 g) was accurately weighed into a standard test tube with a plug of cotton wool at the top. The samples were placed in a preheated water bath at 75°-80° C., with occasional agitation, for 15 minutes and then allowed to stand at room temperature. The samples were examined for crystallization (or sign of opacity) at the following time intervals; 5, 10, 15, 20, 25, 30, 45, 60, 90 and 120 minutes after being removed from the water bath.

The results are given in Table II together with those of comparative couplers of the prior art (whose full structures are given in Table III). It can be seen that the couplers of the present invention exhibit superior solubility over their straight chain counterparts.

The test is considered to be a good indication of how a coupler will behave in a photographic coating.

TABLE II

| Coupler | Ballast Group | Time remained as a clear solution (min) |
|---|---|---|
| 1 | $-COO(CH_2)_2O-COC_{12}H_{25}$-n | >120 |
| C1 | $-COOC_{14}H_{29}$-n | 20-25 |
| C2 | $-COOC_{16}H_{33}$-n | 45-60 |
| 2 | $-(CH_2)_{10}-COOC_2H_5$ | 90-120 |
| C3 | $-C_{12}H_{25}$-n | 20-25 |
| 3 | $-(CH_2)_{10}-COOC_2H_5$ | 60-90 |
| C4 | $-C_{12}H_{25}$-n | 0 |
| 4 | $-COO-(CH_2)_2-OCO(CH_2)_6CH_3$ | >120 (glass) |
| 5 | $-COO-(CH_2)_2-OCOCH(Et)-C_4H_9$-n | >120 (glass) |
| C5 | $-COOC_{12}H_{25}$-n | <5 |

TABLE III

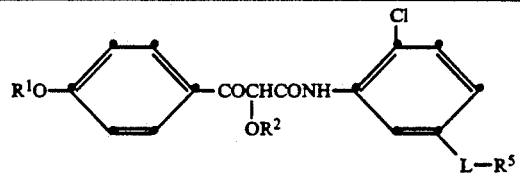

| Coupler | $R^1$ | $-L-R^5$ | $-OR^2$ |
|---|---|---|---|
| C1 | $-CH_3$ | $-COOC_{14}H_{29}$-n | SDP |
| C2 | $-CH_3$ | $-COOC_{16}H_{33}$-n | SDP |
| C3 | $-C_{12}H_{25}$-n | $-Cl$ | SDP |
| C4 | $-C_{12}H_{25}$-n | $-CF_3$ | SDP |
| C5 | $-Bu$-n | $-CO_2C_{12}H_{25}$-n | SDP |

EXAMPLE 2

Preparation of Coupler 3 of Table 1

(a) Ethyl 11-bromoundecanoate

A solution of 11-bromoundecanoic acid (53 g, 0.2 mol) and concentrated sulphuric acid (1 ml) in ethanol (250 ml) was heated to reflux for 24 hr. After cooling to room temperature, the mixture was concentrated to half its original volume by evaporation under reduced pressure. The residue was poured into water (400 ml) and extracted with diethyl ether (3×300 ml). The combined extracts were then washed with saturated sodium bicarbonate solution (3×200 ml) and water (3×200 ml). After drying over $MgSO_4$ the solvent was evaporated under reduced pressure to give a yellow coil (55.5 g, 95%)

(b) Ethyl 11-(4-acetoxyphenoxy)undecanoate

A mixture of the bromoester from (a) (55.3 g, 0.19 mol), 4-hydroxyacetophenone (25.7 g, 0.19 mol) and potassium carbonate (26.1 g, 0.19 mol) in acetone (250 ml) was heated to reflux with stirring for 2 days. After cooling to room temperature, water (500 ml) was added and the whole mixture extracted with ethyl acetate (3×300 ml). The combined extracts were then washed with 3N sodium hydroxide solution (300 ml), water (2×300 ml), 3N HCl solution (200 ml) and water (2×300 ml). After drying over $MgSO_4$ the solvent was removed by evaporation under reduced pressure and the residue recrystallized from methanol to give a white solid (42.9 g, 65%).

Found C, 72.33; H, 9.41; $C_{21}H_{32}O_4$ requires; C, 72.36; H, 9.26%.

(c) Ethyl
11-(4-ethoxycarbonylacetoxyphenoxy)undecanoate

The product from (b) (42 g, 0.12 mol) was added portionwise to a suspension of potassium t-butoxide (21.3 g, 0.19 mol) in diethyl carbonate (56.6 g, 0.48 mol) at 75° C. over 10 minutes. Heating was continued at 95° C. for 1 h. After cooling to 50° C., the suspension was poured into cold water (1 liter) and extracted with ethyl acetate (3×400 ml). The organic solution was dried and evaporated under reduced pressure to give the product (47 g, 93%) as a yellow waxy solid which was used in the next reaction without further purification.

(d) Ethyl
11-{4-[2-(2-chloro-5-trifluoromethylphenylcarbamoyl-)acetoxy]phenoxy}undecanoate A solution of the product from (c) (47 g, 0.112 mol) and 3-amino-4-chlorobenzotrifluoride (21.9 g, 0.112 mol) in xylene (450 ml) were heated to reflux for 5 h. Over the final hour, the volume of the mixture was reduced to 200 ml by distillation. After cooling to about 80° C., the solution was poured into petrol (b.p. 60°-80° C. (1 liter) with rapid stirring. A pale yellow solid was collected by filtration and then recrystallized from petrol (b.p. 60°-80° C.) to give an off white solid (40.5 g, 63%).

(e) Ethyl
11-{4-[2-chloro-2-(2-chloro-5-trifluoromethylphenylcarbamoyl)acetoxy]phenoxy}undecanoate Sulphuryl chloride (9.5 g, 70.2 m mol) in dichloromethane (15 ml) was slowly added to a solution of the 4-equivalent coupler from (d) (40 g, 70.2 m mol) in dichloromethane (250 ml). After stirring at room temperature for 20 h, the volatiles were evaporated under reduced pressure. The crude product was purified by silica gel column chromatography (elutant 10% ethyl acetate in petrol (b.p. 60°-80° C.)) followed by recrystallization from methanol to give a white solid (25.2 g, 60%).

Found C, 57.67; H, 5.56; Cl, 11.60; F, 9.47; N,2.33. $C_{29}H_{34}Cl_2F_3NO_5$ requires; C, 57.62; H, 5.67; Cl, 11.73; F, 9.43; N, 2.32%.

(f) Ethyl
11-{4-[2-(2-chloro-5-trifluoromethylphenylcarbamoyl)-2-(4-((4-hydroxyphenylsulphonyl))phenoxy)acetoxy]-phenoxy}undecanoate Triethylamine (12.12 g, 120 mmol) was added to a solution of the chloro-coupler (24.5 g, 40.5 mmol) from (e) and 4,4'-sulfonyldiphenol (40.5 g, 162 mmol) in dry DMF (130 ml) which has been degassed with nitrogen. After stirring at 45°-50° C. under nitrogen for 1 h, the suspension was cooled and poured slowly into cold water (300 ml) and conc. hydrochloric acid (10 ml), with rapid stirring. The whole mixture was extracted with ethyl acetate (500 ml) and the organic solution washed with 3N sodium carbonate (2×400 ml), 3N hydrochloric acid (300 ml), dried over $MgSO_4$ and evaporated under reduced pressure. The crude material was purified by silica gel column chromatography (gradient elution from 20% ethyl acetate in petrol (b.p. 60°-80° C.) to 60% ethyl acetate in petrol (b.p. 60°-80° C.) followed by recrystallization from methanol to give a white solid (13.5 g, 41%).

Found C, 60.29; H, 5.25; Cl, 4.16; F, 6.98; N, 1.69; S, 3.91. $C_{41}H_{43}ClF_3NO_9S$ requires; C, 60.18; H, 5.30; Cl, 4.33; F, 6.97; N, 1.71; 5, 3.92%.

The invention has been described in detail with reference to preferred embodiments thereof but it will be understood that variations and modifications can be effected within the spirit and scope of the invention.

I claim:

1. A photographic element comprising a support bearing at least one silver halide emulsion layer having associated therewith a non-diffusible dye-forming coupler of the general formula:

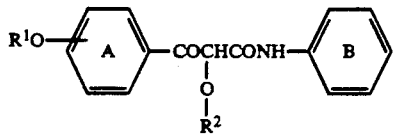

wherein $R^1$ is a cyclic or non-cyclic aliphatic hydrocarbon group which may be substituted or unsubstituted, branched or unbranched, $R^2$ is an aryl group which may be substituted or unsubstituted, and wherein at least one of the rings A and B contains a ballasting substituent comprising an alkyl group which has the formula:

$$-(CH_2)_p-L^1-(CH_2)_q-CH_3$$

in which $L^1$ is —O—CO— or —CO—O—, and p and q are each 2-12.

2. The element of claim 1 wherein the aryl group $R^2$ is substituted with one or more substituents selected from alkyl, amide, ester, carbamoyl, sulphonamide, sulphamoyl, sulphone, ether, thioether nitrile, nitro groups and halogen atoms.

3. The element of claim 1 wherein the ballasting group has one of the following formulae:

$$-(CH_2)_2-O-CO-C_{12}H_{25}-n,$$
$$-(CH_2)_2-O-CO-C_7H_{15}-n,$$

$$-(CH_2)_{10}-CO-O-C_2H_5-n,$$
$$-(CH_2)_2-O-CO-CH(Et)Bu$$

4. The element of claim 1 wherein $R^3$ is an alicyclic group of 5-6 carbon atoms or a non-cyclic groups of 1-20 carbon atoms which may be substituted or unsubstituted, saturated or unsaturated.

5. A photographic element of claim 1 comprising a non-diffusible dye-forming coupler of the formula:

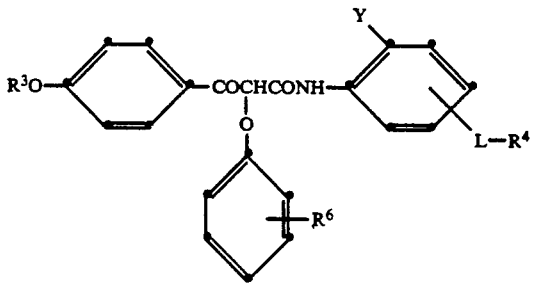

wherein $R^3$ and $R^4$ are each a substituted or unsubstituted alkyl group or a ballast group comprising an alkyl group whose chain is interrupted by an ester group;

Y is chloro or trifluoromethyl,

L is —COO—, —OCO—, —$NR^7$CO—, —CON$R^7$, —$NR^7SO_2$, —SON$R^7$, —O—, —$OSO_2$ or a single bond;

$R^6$ is one or more substituents selected from alkyl, amide, carbamoyl, sulfonamide, sulfamoyl, sulfone, ester, ether, thioether, nitrile, nitro groups and halogen atoms;

$R^7$ is H or alkyl; and in which at least one of $R^3$ and $R^4$ is a ballast group comprising an alkyl group whose chain is interrupted by an ester group.

* * * * *